US010947008B2

(12) United States Patent
Marconel Carpio et al.

(10) Patent No.: US 10,947,008 B2
(45) Date of Patent: Mar. 16, 2021

(54) DETACHABLE PALLET

(71) Applicant: LOGICPALET WORLD, S.L., Valencia (ES)

(72) Inventors: Jose Luis Marconel Carpio, Valencia (ES); Tomas Andres Garcia Guillen, Valencia (ES)

(73) Assignee: LOGICPALET WORLD, S.L., Valencia (ES)

( * ) Notice: Subject to any disclaimer, the term of this patent is extended or adjusted under 35 U.S.C. 154(b) by 0 days.

(21) Appl. No.: 16/622,584

(22) PCT Filed: Jun. 14, 2018

(86) PCT No.: PCT/ES2018/070426
§ 371 (c)(1),
(2) Date: Dec. 13, 2019

(87) PCT Pub. No.: WO2018/229321
PCT Pub. Date: Dec. 20, 2018

(65) Prior Publication Data

US 2020/0207512 A1 Jul. 2, 2020

(30) Foreign Application Priority Data

Jun. 14, 2017 (ES) ..... ES201730799
Jun. 13, 2018 (ES) ..... ES201830576

(51) Int. Cl.
*B65D 19/00* (2006.01)

(52) U.S. Cl.
CPC .. *B65D 19/0093* (2013.01); *B65D 2519/0087* (2013.01); *B65D 2519/0098* (2013.01); *B65D 2519/00273* (2013.01)

(58) Field of Classification Search
CPC ..... B65D 19/06; B65D 2519/00034; B65D 2519/00547; B65D 2519/00552; B65D 2519/00368
(Continued)

(56) References Cited

U.S. PATENT DOCUMENTS 3,878,796 A * 4/1975 Morrison ..... B65D 19/0075 108/56.1
5,579,686 A * 12/1996 Pigott ..... B65D 19/0012 108/56.1
(Continued)

FOREIGN PATENT DOCUMENTS

FR 2703326 A1 * 10/1994 ..... B65D 19/0016
GB 2321045 7/1998
(Continued)

OTHER PUBLICATIONS

International Search Report for PCT/ES2018/070426 dated Dec. 20, 2018.

*Primary Examiner* — Jose V Chen
(74) *Attorney, Agent, or Firm* — Vedder Price P.C.

(57) ABSTRACT

The invention relates to a detachable pallet which comprises a plurality of slides and a plurality of cross-members, wherein the slides comprise anchoring elements, both rigid stops and flexible stops, which contribute to attaching the cross-members to the slides, all in cooperation with tongues and grooves provided in the sides of the cross-members, which are inserted into one another creating a solid, robust joint and a complete load surface. The pallet can also have a tie rod joined to the bottom of the slides, securing same and providing greater robustness to the assembly, allowing it to be used on roller lines.

7 Claims, 5 Drawing Sheets

(58) Field of Classification Search
USPC ..... 108/57.25, 27.26, 56.1, 56.3, 57.26
See application file for complete search history.

(56) References Cited

U.S. PATENT DOCUMENTS

| | | | | |
|---|---|---|---|---|
| 5,941,179 | A * | 8/1999 | Herring | B65D 19/0091 108/57.19 |
| 6,029,583 | A * | 2/2000 | LeTrudet | B65D 19/0012 108/57.25 |
| 6,109,190 | A * | 8/2000 | Hale | B65D 19/0016 108/57.25 |
| 6,263,807 | B1 * | 7/2001 | Fox | B65D 19/0073 108/54.1 |
| 6,938,558 | B1 | 6/2005 | Peres | |
| 7,578,244 | B2 * | 8/2009 | Williams, Jr. | B65D 19/0095 108/56.3 |
| 7,748,329 | B2 * | 7/2010 | Baltz | B65D 19/0048 108/56.1 |
| 8,261,673 | B2 * | 9/2012 | Ingham | B65D 19/0095 108/51.11 |
| 8,448,582 | B2 * | 5/2013 | Jian | B65D 19/0097 108/56.3 |
| 8,651,028 | B2 * | 2/2014 | Storteboom | B65D 19/0095 108/56.1 |
| 8,770,115 | B2 * | 7/2014 | Apps | B65D 19/0014 108/57.25 |
| 8,950,342 | B2 * | 2/2015 | Plattner | B65D 19/0016 108/56.3 |
| 2003/0136314 | A1 * | 7/2003 | Smyers | B65D 19/0012 108/57.26 |
| 2004/0000259 | A1 * | 1/2004 | Taft | B65D 19/0073 108/57.25 |
| 2005/0268824 | A1 * | 12/2005 | Williams, Jr. | B65D 19/0095 108/57.25 |
| 2006/0096508 | A1 * | 5/2006 | Herring | B65D 19/0095 108/54.1 |
| 2009/0050030 | A1 * | 2/2009 | Apps | B65D 19/0018 108/53.3 |
| 2009/0320723 | A1 * | 12/2009 | Low | B65D 19/0093 108/56.3 |
| 2012/0132114 | A1 * | 5/2012 | Krupka | B65D 19/0095 108/57.25 |
| 2012/0298015 | A1 * | 11/2012 | Jian | B65D 19/0097 108/56.1 |
| 2013/0160680 | A1 * | 6/2013 | Ten Bok | B65D 19/0026 108/50.11 |
| 2016/0114936 | A1 * | 4/2016 | Muirhead | B65D 19/0012 108/25 |

FOREIGN PATENT DOCUMENTS

| | | |
|---|---|---|
| JP | 2001328632 | 11/2001 |
| WO | WO2009121056 | 10/2009 |

* cited by examiner

DETACHABLE PALLET

The present invention, as indicated by its title, relates to a detachable pallet comprising a series of skids and a series of crossbars being firmly connected by their geometries and pressure connectors without the need of any other element or attachment material.

No screws or any other attachment pieces are needed to attach the crossbars to the skids. Instead, the shape of the pieces allows keeping them firmly connected.

The field of the art of the invention is that of transportable structures.

BACKGROUND OF THE INVENTION

Pallets have been used to carry loads for a very long time. However, these pallets must make several trips without load, which due to their volume can sometimes make their recovery uneconomical.

It is also not easy to sell new pallets from great distances, since the path between the manufacturer and the first user is also performed without a load.

To help carry a greater number of pallets in a single transport unit, such as a truck or container, detachable pallets have been conceived such that, when their function is complete with the load on a transport means, the pallets can be detached to save space.

Detachable pallets also favour the replacement of broken parts as in non-detachable pallets when a part breaks the pallets generally becomes unusable, with the resulting economic and environmental costs.

The prior art for detachable pallets includes the following:

Utility model ES245986 relates to a detachable pallet, which in order to stiffen the assembly requires the longitudinal elements to be joined to each other at the top and bottom, increasing the number of parts to use in the assembly.

Utility model ES1018770U relates to a detachable pallet whose elements are connected to each other by a series of lugs crossed by rods, therefore requiring these linking elements as well as the longitudinal and transverse parts that make up the structure.

Utility model ES1033284U relates to a detachable pallet whose parts are connected to each other by a sandwich type arrangement, in which the central part has been provided with protrusions that engage orifices made in the outer parts. This solution presents some manufacturing problems, essentially derived from the protrusions that must be joined to the slat at a later stage, as well as transportation problems since the presence of the protrusions prevents optimising space during transport when the pallet is detached.

Utility model ES1018770U relates to a detachable pallet configured from a horizontal platform provided with cutouts in the form of tabs, where said tabs must be able to deform until assuming a vertical position, which limits the materials for which this technical solution can be used.

European patent EP0516681, published in Spain as ES2093698, relates to a detachable pallet consisting of two hollow metal skids facing opposite each other, the opposing faces thereof being provided with a series of orifices in which can be inserted and secured crossbars provided on their lower face with slots with an arrangement and shape allowing them to be fixed against the inner vertical walls of said skids. This technical solution requires the crossbars to be made of metal.

Patent US2007/0221537 relates to a three-dimensional structure made from several parts that are assembled to each other, wherein said parts are made from or at least filled with several layers of cardboard or corrugated paper. This patent requires for its execution several different types of parts. In addition, the assembly generates protrusions in the structure that hinder the handling and storage thereof.

U.S. Pat. No. 8,113,129 relates to a pallet formed by several parts, skids and crossbars, assembled to each other, each of said crossbars and skids comprising two parts which when joined hold the part that they cross and are in turn held by said part. The assembly proposed produces protrusions that hinder the handling and storage of the pallet.

Patent US2009/0298015 relates to a detachable pallet formed by a number of parts, stringers and crossbars, that cross to form the pallet, attached by pressure with the attachment reinforced by rods that cross the parts longitudinally once the pallet is assembled. This patent requires various parts and rods and, due to the attachment method, protrusions are created that hinder the handling and storage of the pallet.

Spanish patent P20133046, of the applicant, relates to a pallet formed by a series of skids and crossbars where the skids, arranged by pairs placed opposite each other, are closed to catch the crossbar parts housed in notches made in the stringers, thereby generating a solid structure.

Patent EP14741117.7, also by the applicant, relates to another structure that can be assembled and disassembled without the need for screws or adhesives, provided with skids and crossbars, where said crossbars are all identical and change their position to fit in slots or notches made in the skids, and where said skids are arranged facing in alternating directions, so that the crossbars are caught in the notches when the skids are aligned.

U.S. Pat. No. 4,077,334 relates to a pallet made from aluminium skids and crossbars that engage each other by a pressure attachment. Due to the mechanics of this type of pallet, it is not possible to obtain a complete load surface, instead requiring a separation between crossbars to allow assembly and disassembly, since the crossbars are deformed laterally for the pressure adjustment. Another problem of this type of pallet is that the pressure or clip action is performed by the side of the crossbar, which is a long part and can easily lose pressure due to use or knocks, making it unusable. Moreover, it cannot be made from plastic, requiring instead aluminium with the resulting cost and production limitations of said material, as well as making it inadvisable to store outdoor or for maritime transport.

U.S. Pat. No. 3,878,796 relates to a plastic pallet with parts, skids and crossbars, that engage by sliding the crossbars on the stringers, since the crossbars have a complementary cross-section to orifices made in the skids. The mechanics of this patent requires the existence of a separation between the crossbars.

None of the above-discussed patents allow generating a structure with a complete surface, as required for some uses, as well as a simple and quick assembly that can be done part by part without undue effort, as well as ideal strength performance in two respects: strength of the pallet, which will remain assembled in case of knocks; and strength of each part, which will not be deformed or lose utility due to knocks and impacts suffered during normal use.

DESCRIPTION OF THE INVENTION

To overcome the aforementioned drawbacks, a detachable pallet is proposed with a complete load surface, formed by a plurality of crossbars that is assembled without the need for screws or additional elements to secure the union of the component parts.

Having a complete load surface is essential for use in certain sectors, and the possibility of detaching into small parts is highly advantageous for transporting while empty.

In addition, the absence of screws or other union materials simplifies replacing a broken part and recycling thereof, unlike other pallets where a broken part requires changing the entire pallet, with the resulting economic and environmental cost.

Moreover, returning the pallet to the source company is much more inexpensive, as it can be performed with the pallet detached occupying much less space.

A pallet as the one proposed herein also has the advantage of allowing a simple repair, by simply replacing the damaged part(s), unlike other pallet types in which when one part breaks the whole pallet must be changed.

This pallet, due to its mechanics, can be made from any material with medium stiffness, although the possibility of making it from plastic without affecting its strength and sturdiness implies a further advantage.

In addition, the simplicity of its unions makes assembly and disassembly especially simple.

The pallet is built from skids and crossbars.

Here the term skid refers to each one of the parts constituting the bottom structure of the pallet in the form of beams that support the loading surface of the pallet.

Crossbar refers to each of the parts which, placed perpendicularly on the skids ad attached to same, form the load surface of the pallet.

Each one of the skids is provided on the upper part thereof with a plurality of anchoring elements which comprise one or more rigid stops and one or more flexible stops.

The crossbars have a shape that allows one of their greater sides to be caught by the rigid stops of the skids while the other greater side is fixed by either a flexible stop, by pressure, or by another crossbar by means of its shape.

The crossbars, with the exception of the outer crossbars, once installed, have their sides in contact with each other, thereby generating a complete load surface.

In this way the rigid stops prevent the crossbars from moving beyond a certain point, as well as from moving vertically, while a flexible stop or adjacent crossbar prevents the crossbar from moving back and being released from said rigid stop.

In this way each crossbar is held at its greater sides. One of the greater sides ends at a rigid stop and is held by the bottom orifice thereof, while the other greater side can end at another crossbar or a flexible stop.

In one possible embodiment, referred to as embodiment A, each crossbar is trapped on one of its greater sides by rigid stops and on the other greater side by flexible stops, thereby generating the load surface of the pallet.

In another embodiment, referred to as embodiment B, all the crossbars forming the surface of the pallet are arranged with the same orientation, and each one is trapped on one greater side by rigid stops and on the other greater side by the adjacent crossbar, except for the last crossbar that secures the assembly by a pressure connection with a flexible stop, thereby generating the load surface of the pallet.

In another embodiment, referred to as embodiment C, part of the crossbars is arranged in one direction and another part of the crossbars are arranged in the opposite direction. Each one of these parts or groups of crossbars behaves mechanically as in embodiment B.

In this type of embodiment C, the skids can have a double rigid stop, that is, with a bottom recess facing each end of the skid, so that the groups of crossbars will meet at this stop, facing opposite each other, each group of crossbars reaching the ends of the skid(s) or having rigid stops at the ends of the skids and flexible stops at the central part of the skid.

In any of the embodiments the crossbars are in close contact with each other, generating a complete load surface and contributing jointly to securing the assembly.

To assemble the pallet as described above, the parts must have the following characteristics:

The skid parts are provided on their upper part with a series of anchoring elements to the skid, among which there are rigid stops and flexible stops.

The generic term anchoring elements of the skid will be used to refer in general to both rigid and flexible stops.

A rigid stop is an anchoring element of the skid, regardless of its shape, that limits the movement of the crossbar in both the longitudinal direction of the skid and in the vertical direction.

For this purpose, the rigid stops have a shape comprising a bottom recess, such as an inverted L shape or any other shape with such feature.

A flexible stop is an anchoring element of the skid, regardless of its shape, that comprises a deformable element that yields to the pressure exerted by the crossbar when installed, and returns to its initial position using a recess of the crossbar, filling this recess and retaining the crossbar against the skid.

For this purpose it can have an arrowhead shape or any other shape allowing said operation.

By arrowhead is meant any shape presenting a diagonal plane in the area of contact with the crossbar during the assembly operations thereof.

The rigid and flexible stops are aligned and arranged longitudinally in a regular manner on the upper part of each skid.

The distribution and number of rigid and flexible stops will depend on the type of embodiment desired.

The skids also have recesses on their sides that cross the body of the skid, in which recesses can be inserted the extensions of the transport and stacking machinery such as forklift trucks. To prevent the recesses from weakening the structure, they are closed on the bottom by a reinforcement.

The skids are preferably hollow to reduce their weight, and comprise internal ribs that give the skid the required strength.

The skids can be made from two parts, an upper and a lower part, joined to each other, which reduces manufacturing costs and simplifies demoulding.

The crossbars are flat parts that can be housed on the skids perpendicularly to same, comprising elements that complement the rigid and flexible stops provided on the skids.

There are two types of crossbar, inner and outer.

Inner crossbars are those placed between another two crossbars of any type, in close contact with same.

Outer crossbars are the first and last crossbars in the load surface, so that one of their greater sides, the outer side, is exposed, while the inner side is in close contact with the adjacent crossbar, which is generally an inner crossbar.

The greater sides of the inner crossbars have recesses that can be used to anchor them to the rigid or flexible stops, referred to as anchoring recesses.

Similarly, the inner crossbars also have on the sides of their greater sides a tongue and groove structure that complements those of the adjacent crossbars.

The outer crossbars only have said tongue and groove on the side of one of their greater sides, specifically on the inner side, while the outer side has smooth edges and no tongue and groove joint, but does have the anchoring recesses.

The tongue and groove joint of a crossbar is complementary to that of the adjacent crossbar(s), so that the inner crossbars are inserted in each other by the tongue and groove joint.

In this way, with the pallet assembled the crossbars are closely linked, arranged next to each other and connected to each other by the tongue and groove joint.

The crossbars can comprise tabs in the form of a lip to help secure the load.

The tabs of the inner crossbars are present on their shorter sides, specifically jutting out of the shorter sides, and are referred to as side tabs.

The tabs on the outer crossbars are present on the outer greater side, specifically jutting out of the outer side, and are referred to as front tabs.

In a preferred embodiment the crossbars, both outer and inner, are hollow to reduce their weight and have internal ribs to increase the sturdiness of the assembly.

The upper and lower surfaces of the crossbars can have orifices or a weft to reduce their weight, and in a proposed embodiment, the upper and lower surfaces of the crossbars has a planking, by which is meant a series of longitudinal orifices alternating with covered longitudinal areas, in the form of a grating.

The detachable pallet can also comprise bottom rods arranged perpendicularly to the skids that connect them, increasing the robustness of the assembly and the use of pallets in roller lines.

Figure 1:
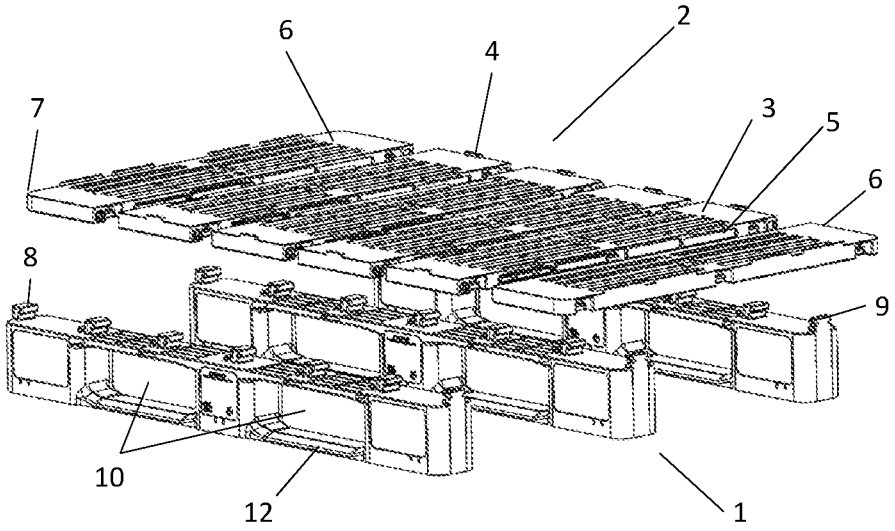
FIG. 1 is an exploded view of a pallet showing the skids (1) and the crossbars (2), where the inner crossbars (3) with their side tabs (4) and the tongue and groove joint (5) on their greater sides can be seen.

The outer crossbars (6) do not have a tongue and groove joint on their outer side and have smooth edges (7).

The skids comprise a body on the upper part of which are the anchoring elements, showing the rigid stops (8) and the flexible stops (9).

The body of the skid presents recesses (10) suitable for inserting therein the ends of a forklift in order to facilitate the transport and handling thereof. These recesses are closed on the bottom by a plank (12) that increases the sturdiness of the assembly and allows using same on a roller line.

Figure 2:
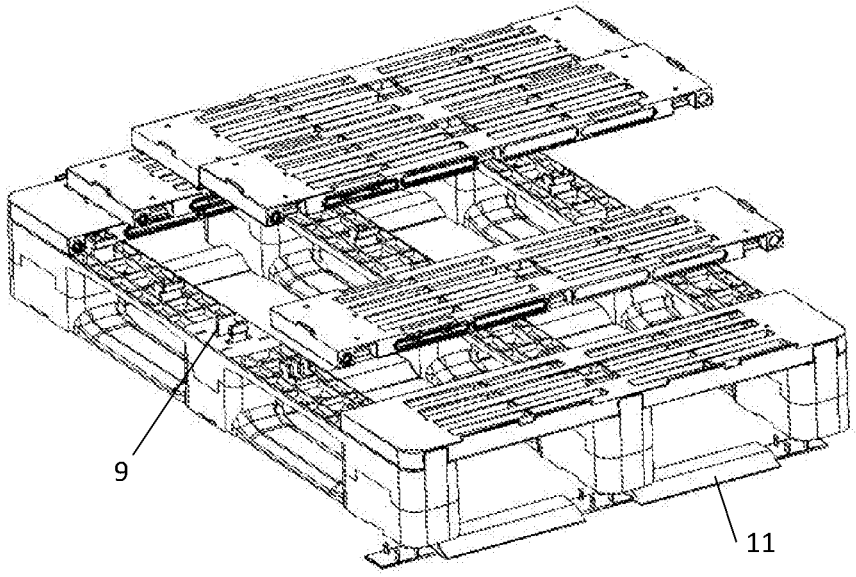

FIG. 2 shows an exploded view of another possible embodiment, where the central part thereof has two opposing flexible stops (9), so that this is a C-type embodiment, with two groups of crossbars in opposite directions with respect to each other.

This figure shows a bottom rod (11) in a position for connection to the structure of the pallet, specifically at the lower part of the skids. This optional rid increases the sturdiness of the assembly and facilitates the use of the pallets on roller lines.

Figure 3:
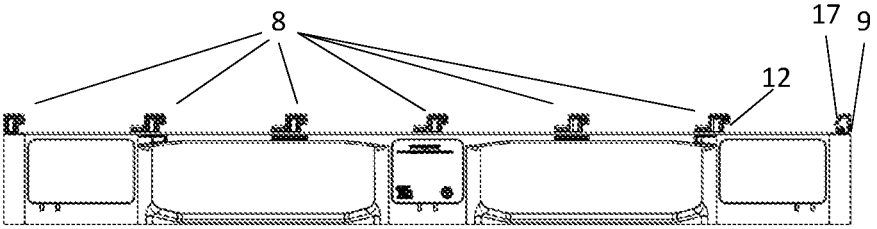

FIG. 3 shows an example of a skid showing more clearly the rigid stops (8) which each have a bottom recess (12), and the flexible stops (9), in this case with an arrow or half-arrow shape, showing on the upper part of said flexible stop a deformable element, in this case an arrowhead (17) that can yield under the pressure exerted by the crossbar and subsequently return to its position.

Figure 4:
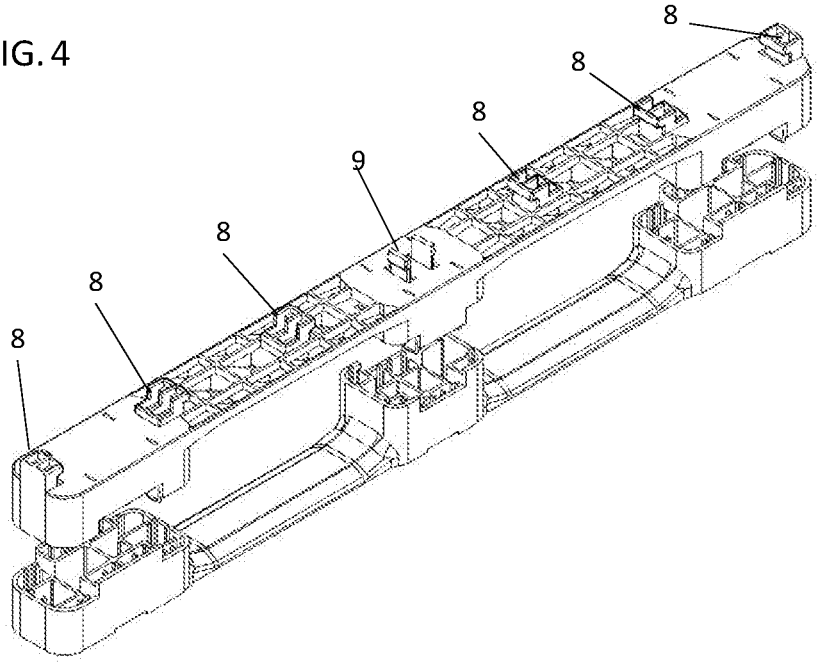

FIG. 4 shows an embodiment of a skid, in this case made from two parts, an upper and a lower part, with two flexible stops (9) opposite each other at the upper central part and a plurality of rigid stops (8) in each of the two longitudinal halves of the skid, arranged in opposite orientations in each half. This figure also shows the inner ribs of the skid.

Figure 5:
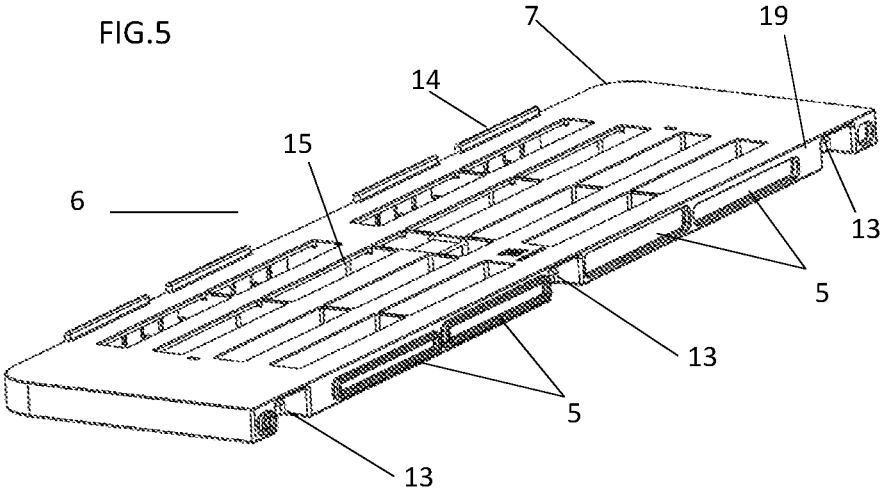

FIG. 5 shows an outer crossbar (6) seen from the inner side (19), showing the anchoring recesses (13), the tongue and groove joint (5) on the inner greater side, the tabs, in this case front tabs (14), the smooth edges (7) and the recesses (15) that reduce the weight of the crossbar.

Figure 6:
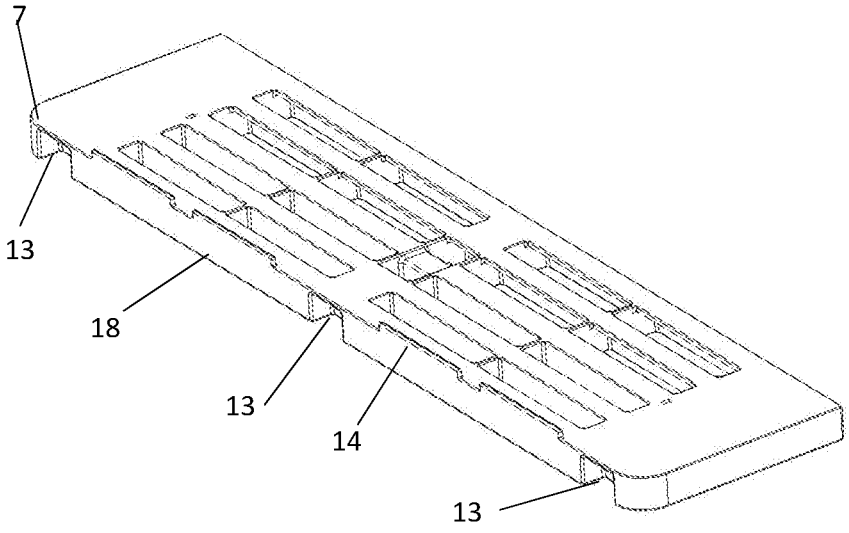

FIG. 6 shows an outer crossbar (6) from the side of the outer side (18) showing the front tabs (14), the smooth edges (7) and the anchoring recesses (13) of the outer side.

Figure 7:
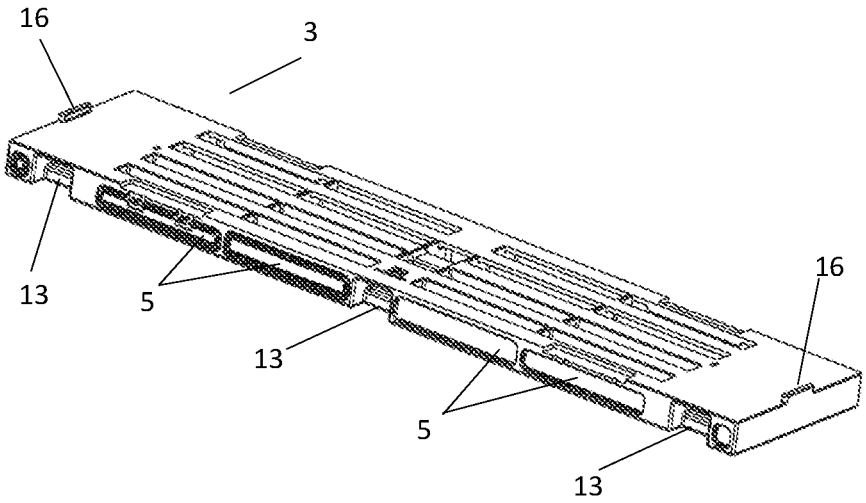

FIG. 7 shows an inner crossbar (3) with the side tabs (16), the anchoring recesses (13) and the tongue and groove joint.

Figure 8:
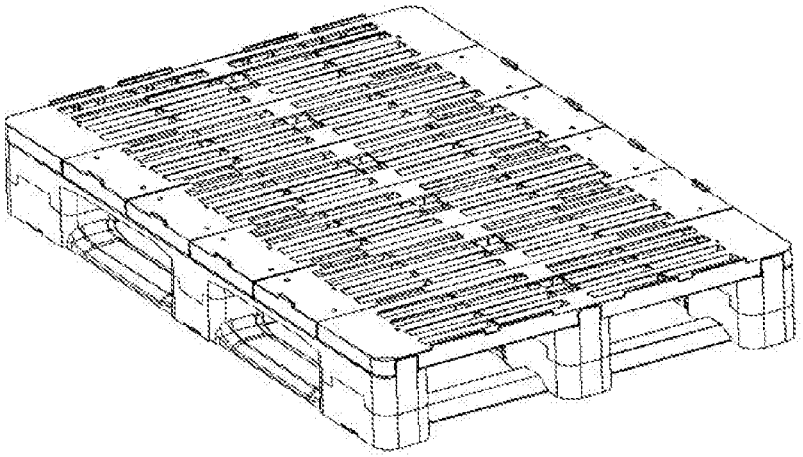

FIG. 8 shows an assembled pallet of the type in which each skid piece is formed from two parts that are joined permanently, the essential advantage thereof being in the manufacturing stage. This pallet also has rods on its bottom part. It can be seen that the crossbars are in close contact with each other at their sides, generating a complete load surface.

Figure 9:
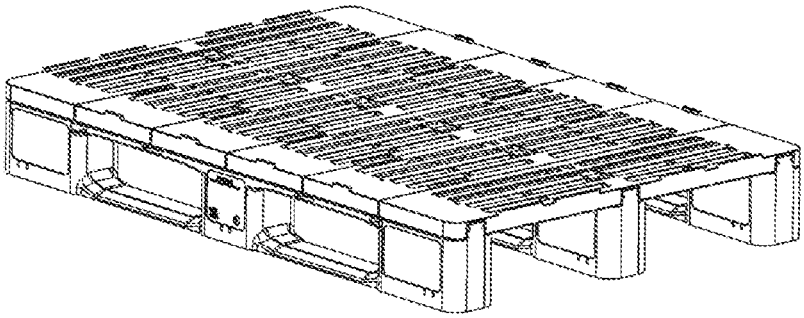

FIG. 9 shows a pallet mounted in another possible embodiment. It can be seen that the crossbars are in close contact with each other at their sides, generating a complete load surface.

DESCRIPTION OF AN EMBODIMENT OF THE INVENTION

An embodiment is described below for illustration purposes only and in no way limiting the invention, since as indicated in the description part, there are various possible embodiments and the present patent provides technical solutions applicable to other arrangements that are not described.

The detachable pallet comprises a plurality of skids (1), specifically three, and a plurality of crossbars (2), specifically six, of which four are inner crossbars (3) and two are outer crossbars (6), although these numbers may be different in other embodiments.

The skids comprise on their upper part a number of anchoring elements, specifically six rigid stops (8) and one flexible stop (9), although the total number of each type can be different in other embodiments.

The rigid stops comprise an inverted L shape that generates a bottom recess (12) suitable to house in it the anchoring recesses of a crossbar, holding said crossbar in place.

The flexible stops (9) have an arrowhead cross section and a deformable arrowhead end (17) such that in the assembly operation the crossbar pushes vertically down on the arrowhead (17) of the flexible stop (9), making the arrowhead yield to allow the crossbar to pass and when the arrowhead finds the corresponding anchoring recess (13) it returns to its original position, entering the anchoring recess and holding the crossbar in place.

In the embodiment described herein the pallet is assembled as described below.

The skids (1) are placed in parallel at the correct distance from each other facing in the same direction.

The first crossbar installed, an outer crossbar (7), is placed meeting against the rigid stops (8) of the end of the skids, inserting said rigid stops in the anchoring recesses (13) of the outer side (18) of the outer crossbar.

With the rigid stops inserted in the anchoring recesses (13) of the outer side, the crossbar will rest on the skids.

The inner side of this outer crossbar is in contact with the next rigid stops at the part where the latter do not have a lower recess.

The next crossbar, in this case an inner crossbar, is inserted in these rigid stops, anchoring the crossbar to the rigid stops and left in close contact with the outer crossbar thereby holding it by means of the complementary tongue and groove joints (5) of the two crossbars at their adjacent sides.

This operation is repeated such that each crossbar installed helps hold the previously installed crossbar.

Finally, another outer crossbar is fitted which has a tongue and groove joint on its inner side helping to secure the previously installed crossbar, while its outer side pushes against the arrowheads (17) of the flexible stops of this end of each skid, such that they yield and allow the crossbar to slide until the arrowheads, in a forced position, coincide with the attachment recesses (13) of the outer side of the outer crossbar being fitted, and return to their natural position entering said anchoring recesses and securing the crossbar and all the others by closing the assembly.

In this way a complete loading surface is obtained without separations between the crossbars.

Each skid is crossed by two recesses (10) with a size suitable for inserting therein the extensions of transport and stacking machinery such as forklift trucks.

These recesses are closed on their bottom by a plank (12) that increases the sturdiness of the skid and allows using same on a roller line.

The skids are hollow to reduce their weight and have inner ribs to increase their sturdiness.

The outer (6) and inner (3) crossbars are hollow and form a complete surface, although a weft may be present to reduce the weight of the assembly.

This surface is limited by peripheral tabs, which can be front tabs (14) and side tabs (16). These tabs allow securing the load to prevent it from sliding.

There is no structural difference between the crossbars and these may be interchangeable. However, for utility, handling and safety reasons, the outer crossbars (6) have smooth edges (7).

The pallet can also incorporate on its bottom a series of rods (11) joined by shapes on the base of the skids that contribute to the sturdiness of the assembly while facilitate its use on a roller line or on other irregular surfaces, preventing snagging.

The invention claimed is:

1. A DETACHABLE PALLET comprising: a plurality of skids (1) and a plurality of crossbars (2), wherein a. each of the plurality of skids (1) includes: an upper part and a lower part that are connected to define cut-outs (10) that extend transversely through the skid, where each cut-out is closed on a bottom side by a plank (12) and is configured to receive a fork of a forklift truck;

a plurality of anchoring elements disposed on the upper part of the skid (1), where the anchoring elements include a plurality of rigid stops (8) and at least one flexible stops (9), where each of the rigid stops (8) includes a bottom recess (12) formed therein that has an opening and where the at least one flexible stop (9) includes a deformable element that is configured to deflect away from the opening; and b. the plurality of crossbars includes a pair of outer crossbars (6) and plurality of inner crossbars (3), and where each crossbar has anchoring recesses (13) formed on longitudinal sides thereof such that each recess (13) includes a projection disposed therein configured to complementarily engage the bottom recess (12) of the rigid stop (8) or the deformable element of the flexible stop (9), and where each of the inner crossbars (3) has a tongue portion and a groove portion disposed on each longitudinal side thereof such that the tongue portion on one longitudinal side is laterally disposed opposite the groove portion on an other longitudinal side, and where each of the outer crossbars (6) has a tongue portion and a groove portion (5) only on one longitudinal side that is disposed adjacent one of the inner crossbars (3) when installed on the skid (1) so as to define an inner side (19) of the outer crossbar (6), and where the tongue portion of one crossbar complementarily engages the groove portion of the adjacent crossbar, and where each inner crossbar includes a pair of tabs disposed on longitudinally opposite sides of thereof, and where each outer crossbar includes a plurality of tabs disposed on a longitudinal side thereof opposite the inner side (19).

2. The DETACHABLE PALLET according to claim 1, wherein the rigid stops (8) are configured with an inverted L shape.

3. The DETACHABLE PALLET according to claim 1, wherein a distal end of the deformable element of the at least one flexible stops (9) is configured as an arrowhead (17).

4. The DETACHABLE PALLET according to claim 1, further comprising rods (11) joined to the lower part of each of the plurality of the skids.

5. The DETACHABLE PALLET according to claim 1, wherein the upper part and the lower part of each skid is formed as a discrete element.

6. The DETACHABLE PALLET according to claim 1, wherein the outer crossbars (6) have smooth edges (7) on the longitudinal side opposite the inner side (19).

7. The DETACHABLE PALLET according to claim 1, wherein the rigid stops (8) and the at least one flexible stop (9) each transversely extend across the upper part are longitudinally aligned along the upper part.

* * * * *